US005898146A

United States Patent [19]

Beck et al.

[11] Patent Number: 5,898,146

[45] Date of Patent: Apr. 27, 1999

[54] MOLDED CASE CIRCUIT BREAKER WITH MODULAR CROSSBAR

[75] Inventors: Henry Richard Beck, Coraopolis; Kenneth Martin Fischer, Finleyville; David Edward Little, Beaver Falls; Joseph Bell Humbert, Monala; Roger William Helms, Beaver Falls, all of Pa.

[73] Assignee: Eaton Corporation, Cleveland, Ohio

[21] Appl. No.: 08/933,288

[22] Filed: Sep. 18, 1997

[51] Int. Cl.[6] ..... H01H 5/00

[52] U.S. Cl. ..... 200/401; 200/244

[58] Field of Search ..... 200/187, 189, 200/244, 401

[56] References Cited

U.S. PATENT DOCUMENTS

| | | | |
|---|---|---|---|
| 3,301,984 | 1/1967 | Wilson | 200/400 |
| 4,540,961 | 9/1985 | Maier | 335/16 |
| 5,260,533 | 11/1993 | Livesey et al. | 200/401 |
| 5,287,077 | 2/1994 | Arnold et al. | 335/8 |
| 5,341,191 | 8/1994 | Crookston et al. | 335/16 |

*Primary Examiner*—Michael L. Gellner
*Assistant Examiner*—Nhung Nguyen
*Attorney, Agent, or Firm*—Martin J. Moran

[57] ABSTRACT

A molded case circuit breaker has modular crossbar members which connect the contact arm carriers of a desired number of poles for opening and closing the separable contacts of all of the poles simultaneously by a single spring powered operating mechanism. The modular crossbar members comprise shaft sections which engage openings in the contact arm carriers of adjacent poles. Bearings support the shaft sections and mount the contact arm carriers for rotation about a common pivot axis. In a preferred embodiment of the invention, the modular crossbar member is a single continuous metal shaft overmolded with an electrically insulative resin which also forms the bearing. Alternatively, separate metal shaft sections seat in sockets on either side of the molded bearing. In both instances, the shaft sections are keyed to the openings in the contact arm carriers for transmission of torque. In the exemplary crossbars, the shaft sections are hexagonal in cross-section.

1 Claim, 13 Drawing Sheets

MOLDED CASE CIRCUIT BREAKER WITH MODULAR CROSSBAR

BACKGROUND OF THE INVENTION

1. Field of the Invention

This invention is directed to molded case circuit breakers, and in particular, to such circuit breakers in which a modular crossbar is used to assemble circuit breakers with a selected number of poles from standardized components.

2. Background Information

Molded case circuit breakers include for each pole a stationary contact and a movable contact forming a set of separable contacts. The movable contact is mounted on a moving conductor assembly which includes a contact arm having the movable contact affixed at a free end of the arm. The other end of the contact arm is supported by a contact arm carrier for rotation between a closed and an open position of the contacts by a spring powered operating mechanism. All of the poles in a multi-pole molded case circuit breaker are connected by a crossbar so that a single operating mechanism opens and closes the separable set of contacts of all of the poles simultaneously. Typically, the crossbar is a molded bar which is formed integrally with part of the contact arm carrier. Different composite molded parts are provided for two, three and four pole molded case circuit breakers.

There is a need to reduce the cost of manufacturing and assembling molded case circuit breakers.

There is a particular need for molded case circuit breakers which can be assembled with a selected number of poles from standardized parts.

There is a related need for such a molded case circuit breaker in which the standardized parts connecting the individual poles are robust enough to transmit the required torque from the common operating mechanism to the individual poles.

SUMMARY OF THE INVENTION

These needs and others are satisfied by the invention which is directed to a molded case circuit breaker having a modular crossbar comprising interchangeable crossbar members which can be used to connect any number of poles together in a multi-pole circuit breaker. The crossbar members include an elongated member with a bearing at the center. The sections of the elongated member on either side of the bearing engage openings in the contact arm carriers of adjacent poles for rotation by the bearing about a common pivot axis. In a preferred embodiment of the invention, the elongated member is a single continuous member having the bearing molded thereon of an electrically insulative resin. Also preferably the elongated member is made of metal for strength and the transmission of torque between poles. In this case, the metal elongated member is overmolded with the electrically insulative resin and at least one end of the metal elongated member is insulated with the electrically insulative resin to electrically isolate the poles. In another embodiment, the sections of the elongated member are separate pieces, also preferably of metal for transfer of torque, which seat in recesses on either side of the electrically insulative molded bearing. In both of these embodiments the sections of the elongated member are keyed to the openings in the contact arm carriers of adjacent poles. Thus, the sections of the elongated member can be polygonal in cross-section and preferably hexagonal with the openings in the contact arm carriers being of a complementary configuration.

In particular, the invention is directed to a circuit breaker which comprises a molded housing in which are mounted a selectable number of poles. Each of the poles includes a separable set of contacts and a moving conductor assembly carrying the moving contact of the set of separable contacts. The circuit breaker further includes a modular crossbar comprising crossbar members connecting adjacent ones of the moving conductor assemblies along a common pivot axis. Each crossbar member includes an elongated member coupled to the adjacent moving conductor assemblies and a bearing pivotally mounting the elongated member, and therefore the moving conductor assemblies, in the molded housing. An operating mechanism coupled to one of the moving conductor assemblies simultaneously opens and closes the separable sets of contacts in the selectable number of poles by rotation of the moving conductor assemblies coupled by the modular crossbar members.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1A:
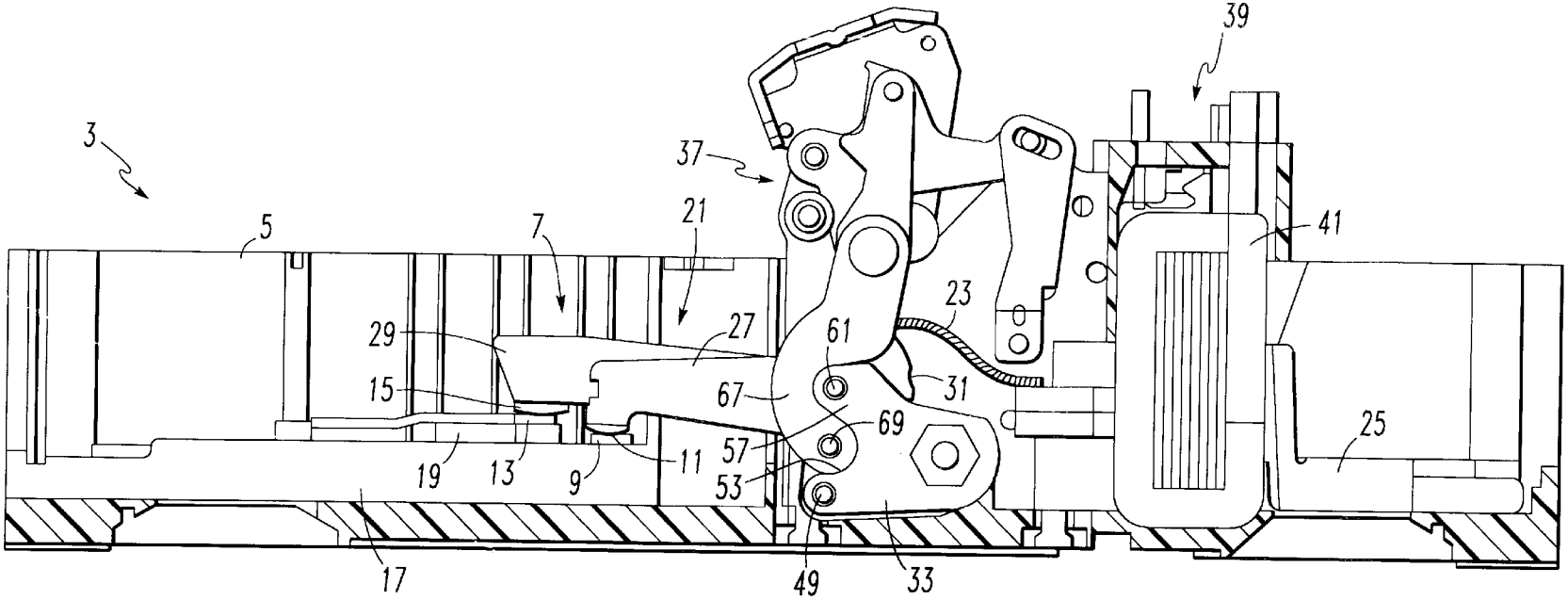
FIG. 1A is a longitudinal sectional view through a circuit breaker incorporating the invention and shown in an "on" position.

FIGS. 1A–1D illustrate the pertinent features of a molded case circuit breaker 1, incorporating the invention. The exemplary circuit breaker 1 is a three pole circuit breaker with the center pole shown in the figures. While the exemplary circuit breaker is a three pole breaker, it will become apparent that the modular construction of the circuit breaker is easily adaptable for assembling similar circuit breakers with fewer or more than three poles.

The circuit breaker 1 includes a molded housing 3 having a base section 5 and a cover (not shown). Each pole has a set of separable contacts 7, which includes a fixed main contact 9 and a moveable main contact 11. In addition, the separable contacts 7 include a fixed arcing contact 13 and a moveable arcing contact 15. The fixed main contact 9 is mounted on a line side conductor 17 electrically connected to a line side terminal (not shown) for connection to an external circuit (not shown). The fixed arcing contact 13 is mounted on a conductor 19 electrically connected to the line side conductor 17.

The moveable main contact 11 and moveable arcing contact 15 are mounted on a moving conductor assembly 21, which is connected by flexible shunts 23 to a load side conductor 25, a terminal end of which serves as a load terminal. When the circuit breaker is closed as shown in FIG. 1A, current from a source (not shown) connected to the line terminal (not shown) flows through the line side conductor 17, the separable contacts 7, the moving conductor assembly 21, the flexible shunts 23, and the load side conductor 25 to a load (not shown).

Figure 2:
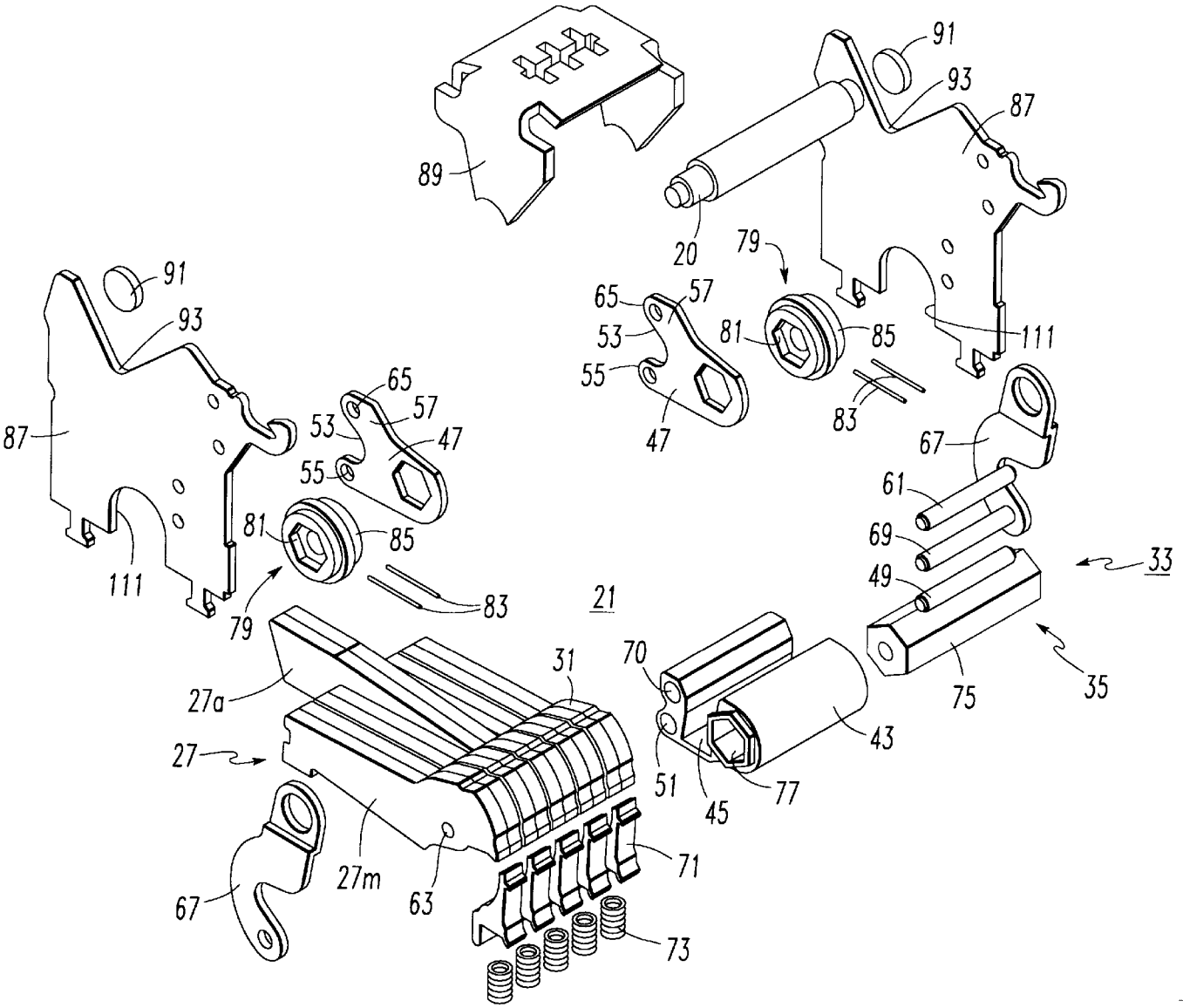
FIG. 2 is an exploded isometric view of a center pole moving conductor assembly in accordance with one embodiment of the invention.

The moving conductor assembly 21 includes a contact arm 27 having a first or free end 29 and a second or supported end 31. The contact arm is assembled from a stack of main contact arm laminations 27*m* and arcing contact lamination 27*a* as shown in FIG. 2. The moveable main contacts 11 are fixed to the free ends of the main contact arm lamination 27*m,* while the moveable arcing contacts 15 are affixed to the free ends of the arcing contact arm lamination 27*a.* As is known, the number of laminations are selected to provide the desired current rating for the circuit breaker as will be discussed in more detail below.

Figure 1B:
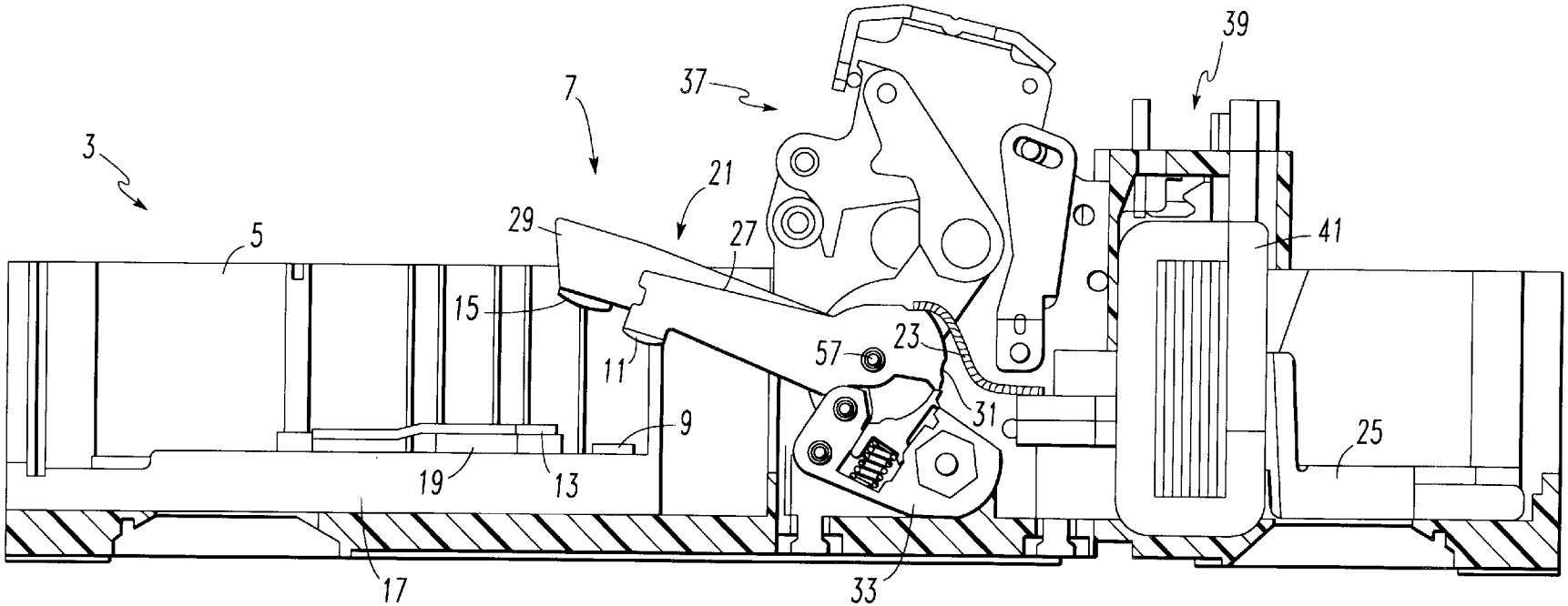
FIG. 1B is similar to FIG. 1A, shown with the circuit breaker in an "off" position.
Figure 1C:
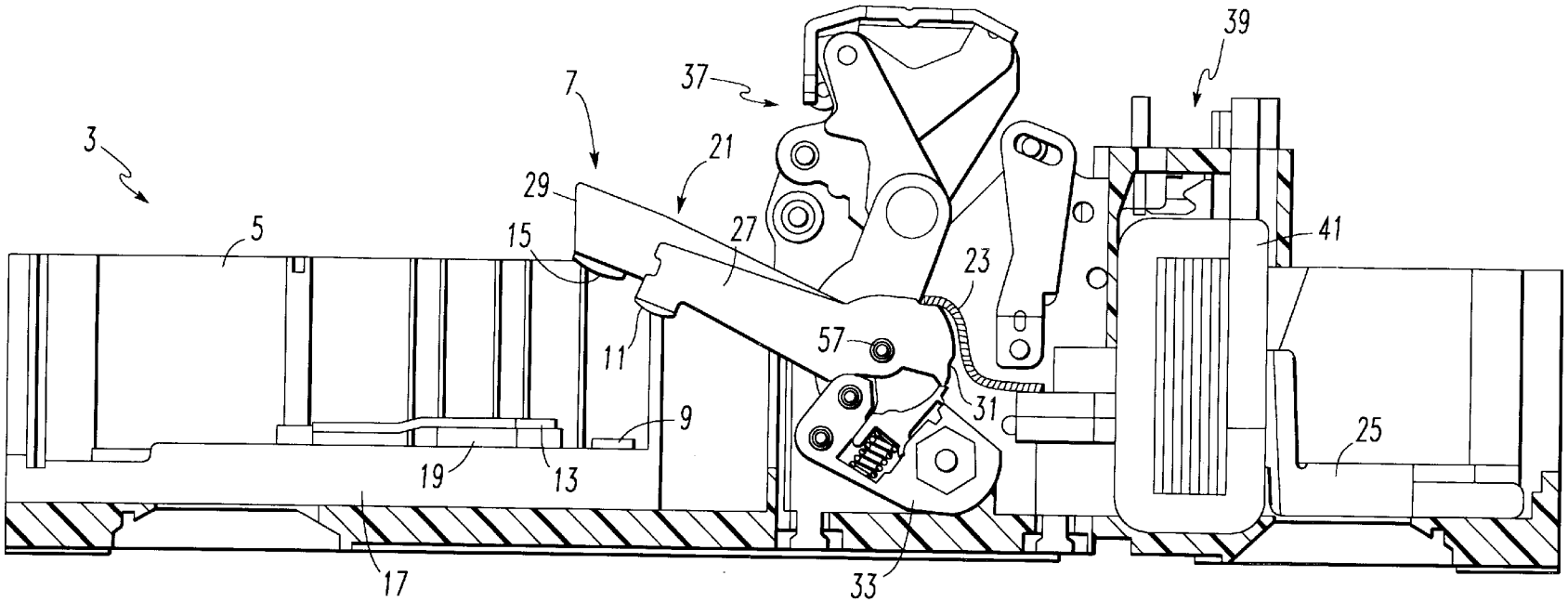
FIG. 1C is similar to FIG. 1A, shown with the circuit breaker "tripped".

Laminated contact arm 27 is supported by a contact arm carrier assembly 33 which in turn is rotatably mounted within the circuit breaker housing by a modular crossbar 35. As will be seen from FIG. 3, the carrier assemblies for all of the poles are mounted on the modular crossbar 35 for rotation together. The spring powered latchable operating mechanism 37 is pivotally connected to the carrier assembly 33 at the center pole for rotating the carrier assemblies 33, and therefore the contact arms 27, of all of the poles, between a closed or "on" position as shown in FIG. 1A, and an open or "off" position as shown in FIG. 1B. Such spring powered operating mechanisms are well known in the art. A trip unit 39, responds to current flowing through the circuit breaker sensed by the current transformer 41 to unlatch the spring powered latchable operating mechanism 37 in response to selectable current conditions. Unlatching of the latchable operating mechanism 37 by the trip unit 39 causes the operating mechanism to rotate the carrier assemblies 33 and therefore the contact arms 27 to a "tripped" position as shown in FIG. 1C to open the separable contacts and interrupt the load current.

Figure 1D:
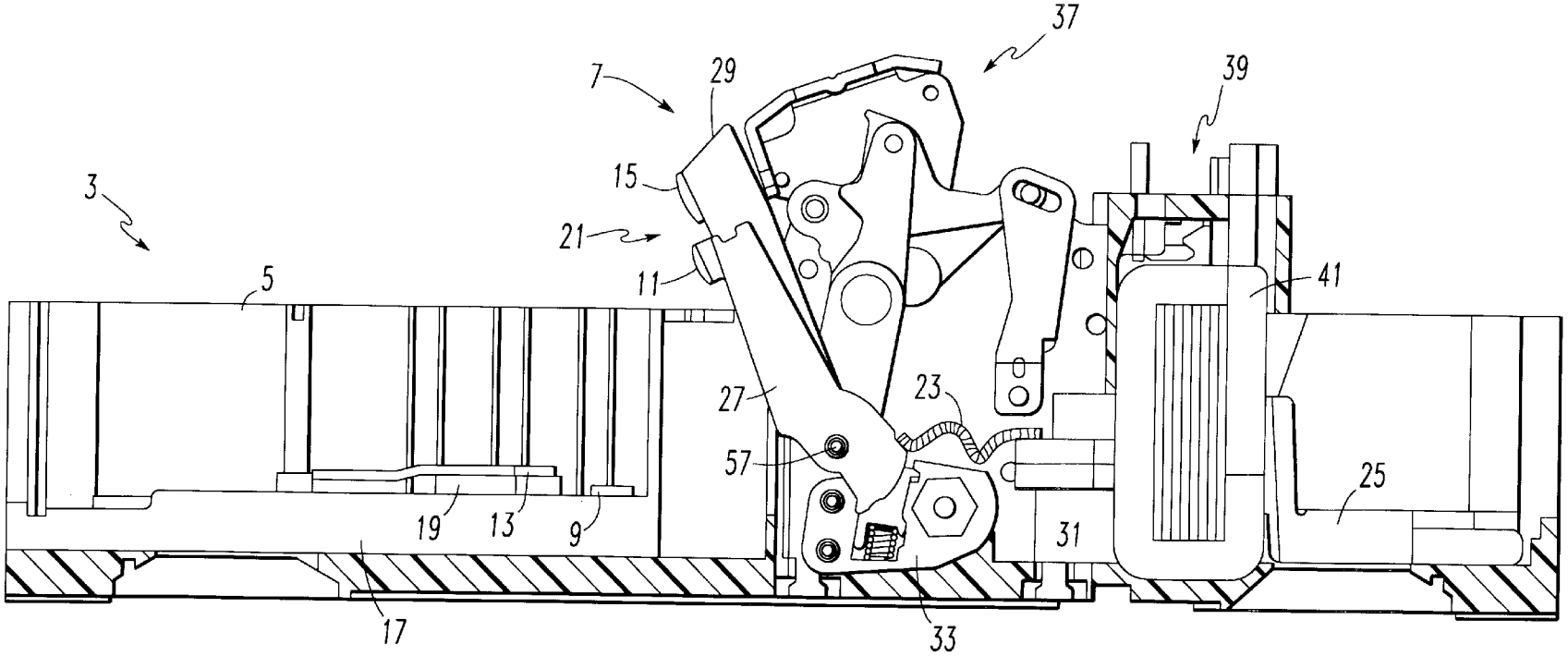
FIG. 1D is similar to FIG. 1A, shown with the contact arms in the "blow off" position.

The circuit breaker 1 is provided with a blow-open feature. There is an inherent time delay in the response of the trip unit 39 and operating mechanism 37 to overcurrent conditions. As is common in molded case circuit breakers, a blow-open feature permits the contact arms 27 to rotate independently of the carrier assembly 33 in response to the very high magnetic repulsion forces generated by short circuit current flowing through the circuit breaker. FIG. 1D shows a circuit breaker 1 in which the contact arms 27 have blown open in response to a short circuit current. While the operating mechanism 37 is still shown in the closed or "on" position, a trip has been initiated and the operating mechanism will actuate and move to the "tripped" position of FIG. 1C.

The present invention, in addition to other advantages, provides an improved blow-open feature. The improved blow-open feature is incorporated into the carrier assembly 33. As best seen in FIGS. 1A and 2, this carrier assembly 33 includes a molded carrier body 43 having a transverse channel 45 which is upwardly open. The carrier assembly 33 also includes metal side plates 47 which close off the ends of the channel 45 when secured to the sides of the carrier body 43 by a pin 49 extending through a bore 51. The side plates 47 have a recess 53 extending inward from a front, peripheral edge 55. A side lobe 57 extends upward from the recess 53 and above the carrier body 43. A pivot pin 61 extending through apertures 63 in the laminated contact arm 27 is journalled in apertures 65 in the lobes 57 to pivotally mount the second end 31 of the laminated contact arm 27 on the carrier assembly 33.

The contact arm carrier assembly 33 is coupled to the spring powered latchable operating mechanism 37 by a pair of spaced apart lower toggle links 67 of the operating mechanism 37. These links 67 are pivotally connected to the carrier body 43 in the recesses 53 in the peripheral edges 55 of the side plates 47 by a pivot pin 69 extending through aperture 70 so that the hooked portions of the links 67 are co-planar with the side plates. Typically, the lower toggle links of the operating mechanism of a molded case circuit breaker are pivotally connected outside the contact carrier which adds to the overall width of the pole mechanism. By making the toggle link 67 co-planar with the side plates 55, more of the width of the pole mechanism can be devoted to the thickness of the contact arm 27. As the amount of copper in the moving conductor assembly affects the electrical resistance of the moving conductor assembly, the thicker the contact arm can be, the higher the current rating can be for a given temperature rise. The arrangement of the contact arm carrier assembly 33 in which the contact arm 27 is pivotally supported on the lobes 57 of the side plates also helps in increasing the current rating of the circuit breaker. This occurs because the current path provided by the contact arm is minimally surrounded by metal in which induced eddy currents generate heat.

FIG. 2 illustrates in an exploded view a moving conductor assembly 33 and some of the cooperating components of the center pole. As can be seen, there are a number of cam members 71 which are received in the transverse channel 45 in the carrier body 43. In the exemplary embodiment, there is one cam member 71 for each pair of main contact arms 27*m* and a separate cam member for the pair of arcing contact arms 27*a,* as will be described in more detail. There is a helical compression spring 73 also received in the transverse channel 45 for biasing each of the cam members 71 against an associated pair of contact arm laminations. The cam members 71 and spring 73 are captured in the channel 45 by the side plates 47 which are secured to the carrier body 43 by the pin 49. Once inserted in the channel from the side, the cam members 71 are restrained from disengaging through the upwardly open face of the channel 45 as will be described in detail below. Thus, the springs and cams are held in place by the side plates 47 while the contact arm laminations 27*m* and 27*a* are connected to the side lobes 57 by the pivot pin 61. This arrangement greatly simplifies the assembly of the moving conductor assembly 21 which reduces cost and improves reliability.

The modular crossbar 35 includes hexagonal shaft sections 75 each of which is coupled to a contact arm carrier assembly 33 by engagement in a hexagonal passage or opening 77 extending transversely through the carrier body 43. While hexagonal bar material is readily available, other non-circular configurations of the crossbar shaft, including other polygon shapes, can be utilized to key the shaft 75 to the carrier body 43, so that they are locked together for rotation by this coupling arrangement. In view of the torque that must be applied to close the contacts at each of the poles against the contact spring pressure using the operating mechanism connected to the center pole, it is important that a solid connection be made between the crossbar and the carrier body. On each end of the crossbar shaft section 75 associated with the center pole is a molded bearing 79 which has a hexagonal recess 81 in which the shaft is received. A similar hexagonal recess in the outer side of each of the bearings, receives a separate hexagonal crossbar shaft section of the adjacent outer poles (not shown in FIG. 2). Roll pins 83 couple the crossbar shafts 75 to the bearings 79. The bearings also have an annular rim 85 on their peripheral surface for laterally locating the crossbar assembly as will be described. FIG. 2 also illustrates a pair of support plates 87 in the center pole which support the operating mechanism 37. For instance, the inverted U-shaped handle yoke 89 of the operating mechanism is supported on roller pins 91 received in notches 93 in the top of the support plate for rotating the handle yoke between the "on", "off" and "tripped" positions as shown in FIGS. 1A–1C. The lower toggle links 67 of the operating mechanism are also shown in FIG. 2.

As the lower ends of the lower toggle links 67 are coplanar with the side plates 47, they are curved so that they extend from the pivot pin 69 around the side lobes 57 to the operating mechanism 37. As can be appreciated from FIGS. 1A and 1B, as the operating mechanism 37 is actuated from the "on" to the "off" position, the contact carrier assembly 33 rotates and therefore provides clearance for the lower toggle links 67 to rotate. However, if the separable contacts 7 become welded closed that the carrier cannot rotate, the links 67 being co-planner with the side plates 47 are engaged by the side lobes 57 and cannot rotate. This prevents the operating mechanism 37 from retaining the handle yoke 89 in the off position shown in FIG. 1*b*. Thus, making the links 67 co-planar with the side plates 47 of the carrier assembly also provides a positive off feature which makes the user aware that the circuit breaker has not opened when the contacts are welded shut. Furthermore, with the links 67 coplaner with the side plate 47, it is possible for a light weld of the contacts to be broken by applying pressure to the handle (not shown) attached to the handle yoke.

Figure 3:
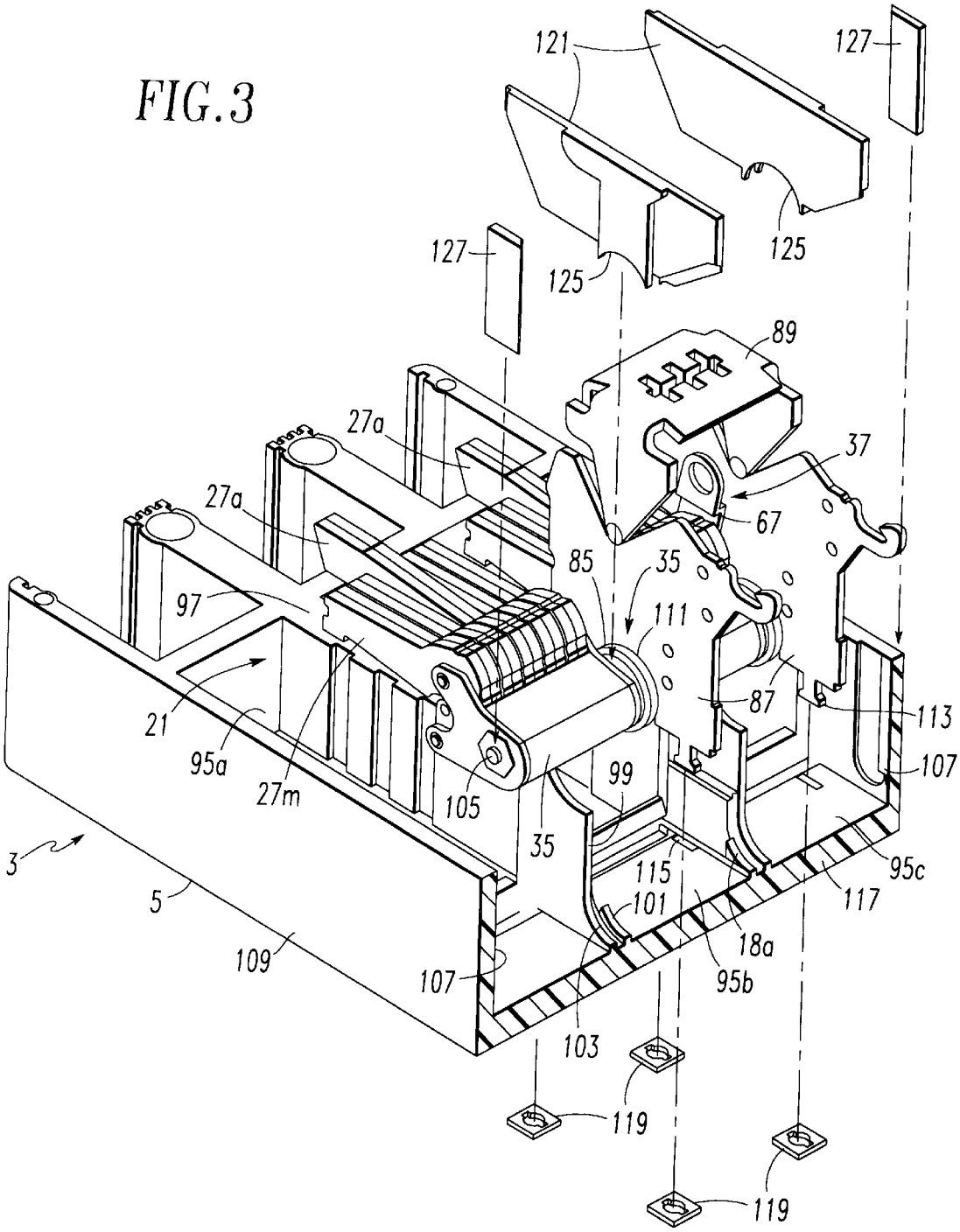
FIG. 3 is an exploded isometric view of the circuit breaker with parts cut away.

FIG. 3 illustrates the mounting of the moving conductor assemblies 21 of the three-pole circuit breaker interconnected by the modular crossbar 35 in the housing 3 of the circuit breaker. The base 5 of the housing 3 is partitioned into three adjacent, parallel compartments 95*a*, 95*b*, and 95*c*, by partitions 97. These partitions 97 have upwardly facing slots 99. Semi-circular bearing blocks 101 at the base of the slots 99 form grooves 103 in which the annular ribs 85 on the crossbar bearings 79 are received as the assembly of moving conductor assemblies and crossbar are lowered into the base. Locating pivots 105 in the outer ends of the crossbar shafts 75 of the outer poles are received in dovetail grooves 107 in the outer walls 109 of the base 5. The support plates 87 for the operating mechanism 37 in the center pole compartment 95*b* have downwardly facing U-shaped slots 111 which form bearing surfaces for the upper halves of the annual ribs 85 on the bearings 79 when the support plates are inserted in the housing. The support plates 87 each have a pair of downwardly projecting twist tabs 113 which extend through slots 115 in the bottom wall 117 of the base 5 and twist plates 119 and are then rotated 90° to secure the support plates in place and fix the position of the rotatable crossbar. Electrically insulative interphase barriers 121 are inserted outboard of the support plates 87 and have offset extensions with arcuate bottom surfaces 125 which seat against the upper side of the bearings 79 outboard of the annual rib 85 to complete the upper half of the journal for the crossbar bearings. Crossbar retaining blocks 127 with chamfered edges are inserted in the dovetail grooves of 107 to fix the position of the locating pivots 105. Operating mechanism 37 is mounted between the support plates 87 in the center pole, although only one of the lower toggle links 67 and the handle yoke 89 are shown in FIG. 3 for clarity.

Figure 4A:
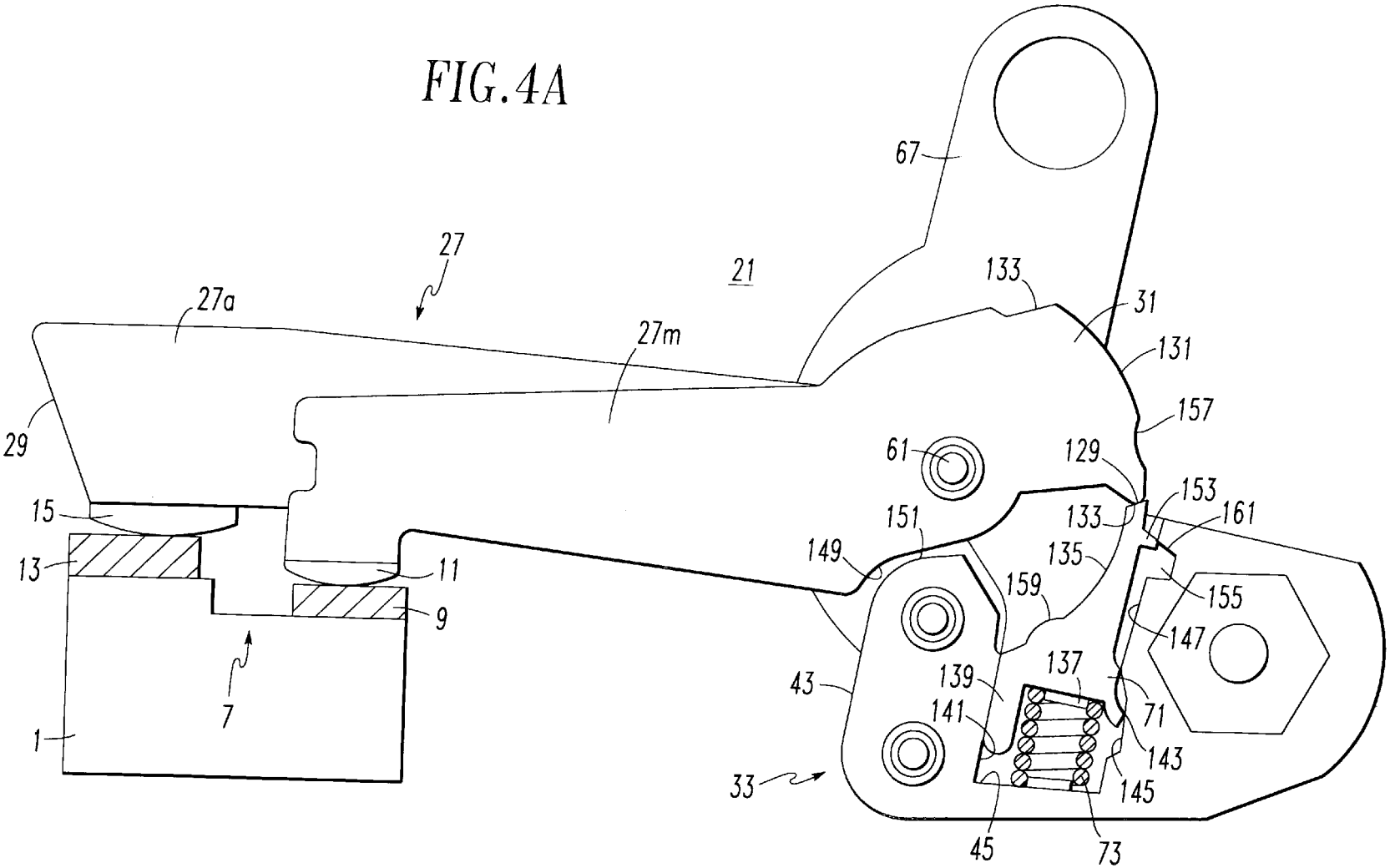
FIG. 4A is an side elevation view with parts cut away, illustrating contact arm cam action with the contact arm in the "on" position and with new contacts.

FIGS. 4A–4E illustrate the blow-open feature. The supported or second end 31 of the contact arm 27 has a contact pressure lobe 129. Adjacent to the contact pressure lobe 129 is a camming surface 131 which generally subtends an arc centered on the axis of pivot 61. Adjacent to the upper end of the camming surface 31 is a flat 133 to which the flexible shunt 23 (see FIG. 1) is brazed. The cam members 71 have a cam end 133 which adjoins a second cam surface 135 which is complimentary to the first cam surface 131 on the contact arm. Projection 137 on the opposite end of the cam member serves as a seat for a contact spring 73. A guide finger 139 extends longitudinally from a corner diagonally opposite the cam end. The cam members 71, each of which in the exemplary circuit breaker 5 bears against a pair of contact arm laminations (27*m*, 27*a*), are housed in the transverse channel 45 in the carrier body 43. The guide finger 139 helps to guide the cam member along a forward side wall 141 of the channel 45 toward and away from the supported end 31 of the contact arm. With the separable contacts 7 closed as shown in FIG. 4A, the contact springs 73 bias the cam members 71 toward the contact arm so that the cam end 133 of the cam member 71 bears against the contact pressure lobe 129 on the contact arm generating a counter clockwise moment as shown in the Figure applying pressure tending to maintain the contacts 7 closed. Closing pressure in the contact is also provided by the operating mechanism through the lower toggle link 67. However, during the service life of the circuit breaker, the contact pairs are subject to conditions which cause them to wear or lose thickness. This may be due to erosion from arcing initiated by switching normal load currents over the life of the products, to arcing during high short circuit currents, or to contact deformation caused by the relatively high forces of closing the contact arms against relatively soft contact materials such as silver alloys. In order to efficiently carry current (minimize contact resistance and heat generation), contact force must be generated and maintained through all wear states of the contact pairs.

Contact force is generated as a balance between loads induced by the springs (not shown) of the operating mechanism 37 and loads created at the contact pair interfaces by the contact springs 73. The contact springs 73 account for the geometry variations and the variations of contact thickness created by the conditions described above. A clockwise moment about the contact arm pivot pin 61 is generated as moving contacts 11 and 15 impinge against the stationary contacts 9 and 13. This moment is balanced by a counter clockwise moment about the pin 61 due to the resisting force of the contact arm cam member 71 at the interface between the cam end 133 and the contact pressure lobe 129 of the contact arm 27. This resisting force is generated by compressing the contact spring 73 by the motion of the cam member 71 in the channel 45 of the carrier body 43.

Figure 4B:
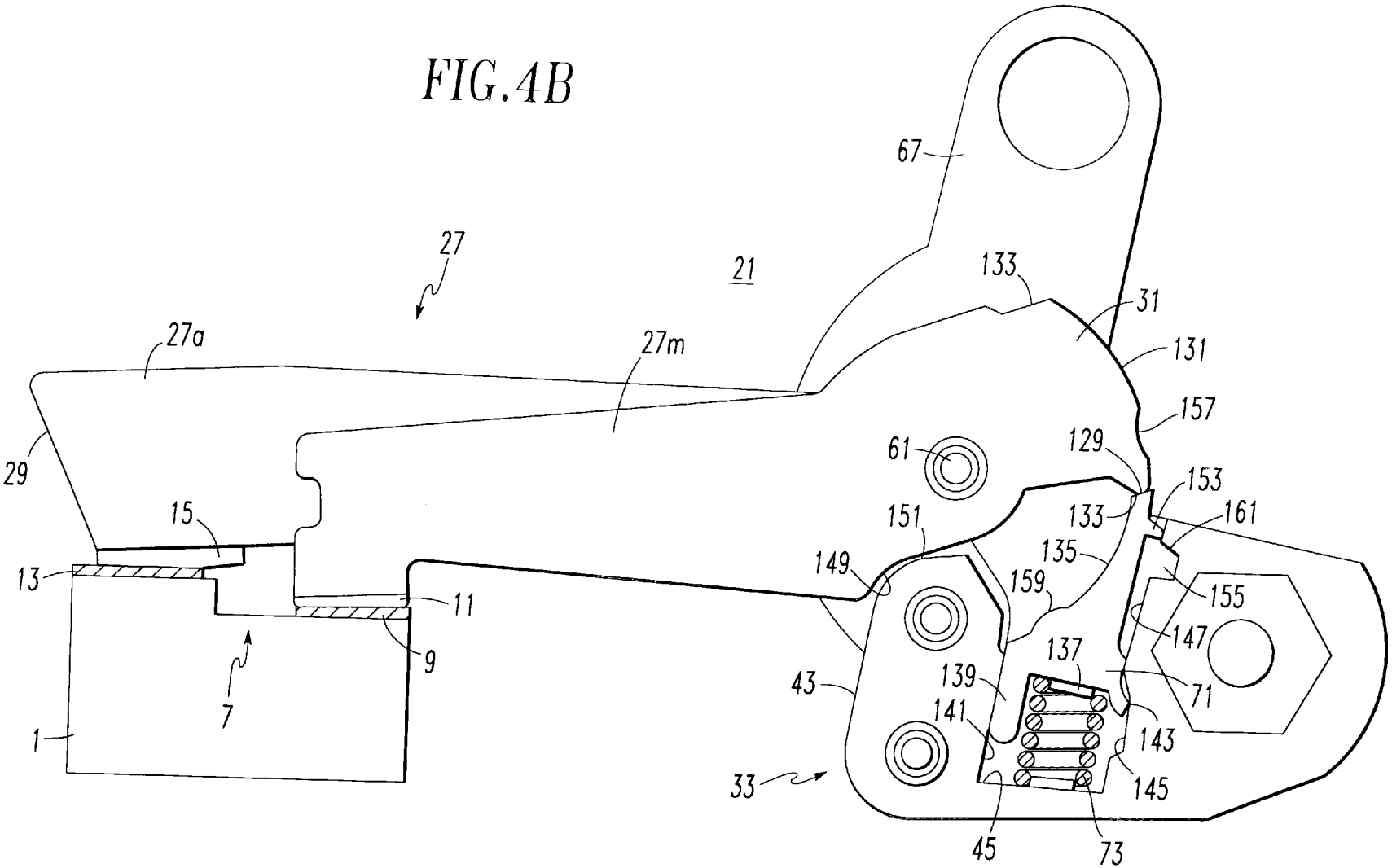
FIG. 4B is similar to FIG. 4A, but shown with worn contacts.

FIGS. 4A and 4B indicate slightly different contact arm orientation about the pin 61 due to changes in thickness of the contacts 7. Contact spring 73 is compressed more for the new state shown in FIG. 4A as indicated by more travel of the contact arm cam member 71 in the channel 45. Since the moment arm and contact spring deflection are nearly constant, the contact force is nearly constant, as well, for all stages of contact wear. Further refinement of contact force is possible by changing the profiles of the contact arm and cam member.

Figure 4C:
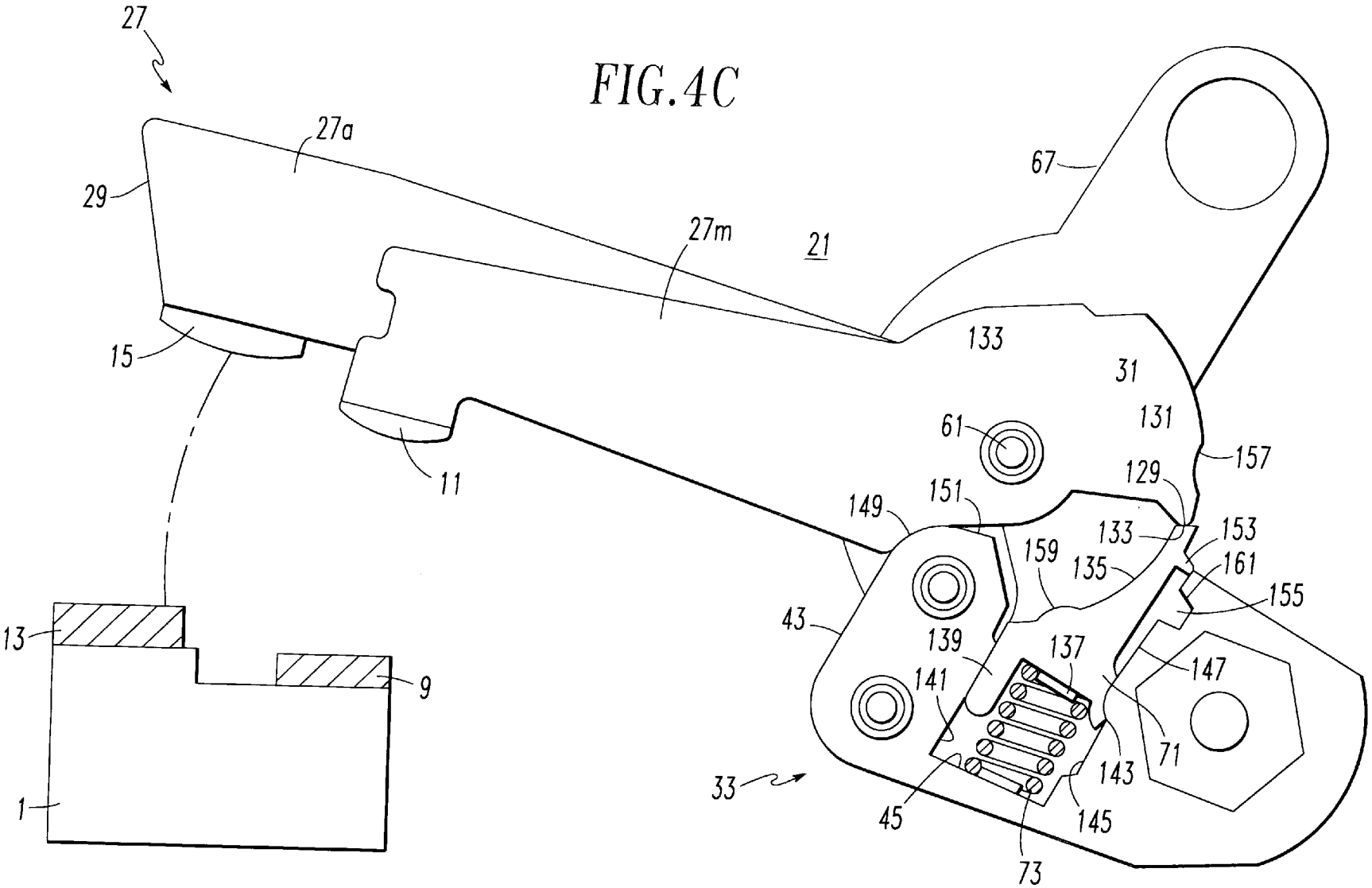
FIG. 4C is similar to FIG. 4A, but shown with the contact arm in the off and tripped positions.

When the circuit breaker 1 is "open", as shown in FIG. 4C, the contact arm cam member 71 is pushed up the channel 45 by the contact spring 73 until a cam retention finger 143, which is received in a slot 145 in wall 147 of the channel 45 engages the carrier body 43. This motion drives the contact arm 27 further counterclockwise about the pivot pin 61 until a contact arm stop profile 149 on the underside of the arm 27 meets a contact arm stop 151 on the carrier body. The motion of the cam member 71 is restrained by the retention finger, but does not prevent the contact arm 27 from rotating counter clockwise. The arm-to-carrier stop is necessary to prevent the arm 27 from pivoting counter clockwise in an unrestrained manner and potentially reclosing the separable contact 7.

The cam retention finger 143 on the cam member 71 also serves an important function during assembly of the moving conductor assembly 21. As mentioned, the cam springs 73 are seated on the individual cam member 71 and inserted from the side into the transverse channel 45 in the carrier body 43. The cam retention finger 143 retains the cam members with a spring preload on them in the upwardly open channel 45. While the tension finger 143 is shown on the cam member 71 and the slot 145 is shown in the side wall 147 of the channel 45, alternatively, the retention fingers project from the wall 147 of the channel 45 and the retention slot 145 could be in the side of the cam member 71.

Figure 4D:
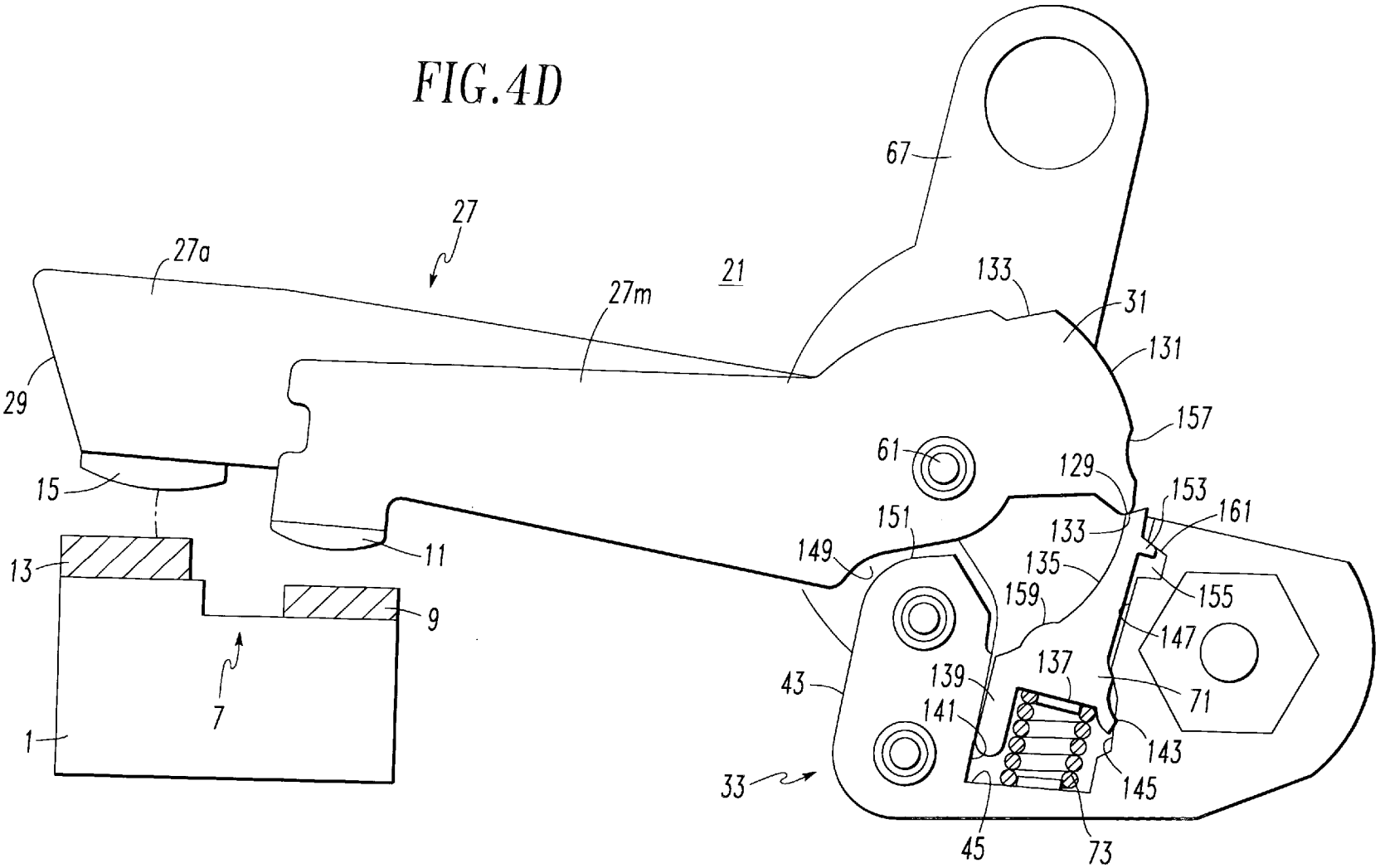
FIG. 4D is similar to FIG. 4A, but showing the contact arm in the process of "blowing off."
Figure 4E:
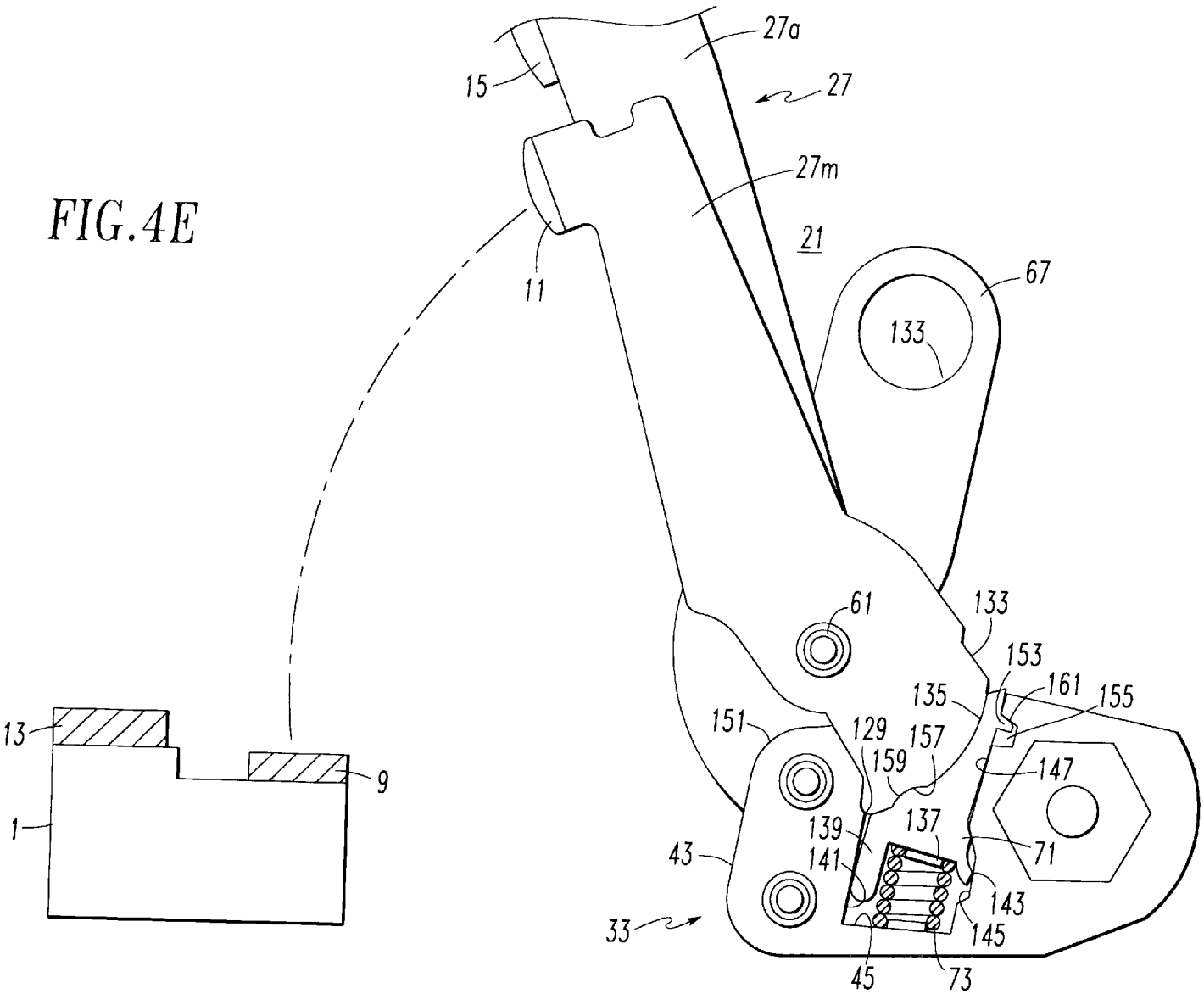
FIG. 4E is similar to FIG. 4A, but showing the contact arm in the full "blow off" and latched position.

During a high short circuit interruption, the contact arms 27 are repelled from the stationary conductor 17 before any motion of the operating mechanism 37 is initiated by the trip unit 39. The crossbar 35 remains essentially at rest during this event. The contact arms 27 pivot around the pivot pin 61 while displacing the contact arm cam member 71 as FIGS. 4D and 4E illustrate. As shown in FIG. 4D, the channel 45 guides the cam member 71 along a path which is generally transverse to the contact arm 27 in the plane of rotation of the contact arm and adjacent the second end 31 of the contact arm. In FIG. 4D, the contact arm 27 has pivoted clockwise about the pivot pin 61 and compressed the contact springs 73 to near their limit. The contact pressure lobe 129 on the arm is just about to slide off the cam end 133 on the cam member 71. This occurs due to the downward translation of the cam member 71 in the channel 45 which allows a lateral blow off projection 153 on the side of the cam member 71 to shift to the right as it slides into a blow off recess 155 in the side wall 147 of the channel 45. The cam member 71 then sidesteps the cam pressure lobe 129 as it pivots, thereby releasing the load which opposes this motion. The contact arm 27 is then free to rotate clockwise as shown in FIG. 4E until a latch-up detent 157 on the contact arm camming surface 131 engages a latch-up bump 159 on the cam surface 135 on the cam member 71. This engagement is intended to prevent the arm 27 from bouncing which could potentially close the air gap just created between the moving and stationary contacts and allow an arc to re-strike. Again, the lateral blow off projection 153 could alternatively be on the wall 147 of the channel 45 and the blow off recess could be in the side of the cam member 71. Also, the latch-up detent could be on the cam member 71 and the latch-up bump on the contact arm. It will be noticed that the blow off recess 155 has a cam wall 161 which is configured to bias the cam member 71 to rotate counter clockwise for resetting the moving conductor assembly to the configuration shown in FIG. 4*c* as the trip unit responds to the short circuit and actuates the operating mechanism 37 to rotate the carrier. This cam wall 161 also provides a slight bias force of the cam surface 135 on the cam member 71 against the camming surface 131 on the contact arm. However, most of the force of the contact spring 73 during blow off is transmitted into the carrier body 37. By utilizing stiffer cam springs 73 for the arcer contact arms 27*a,* the arc arms can be made to blow off at relatively higher levels of short circuit current, or at a relatively lower state than the main contact arm lamination 27*m.* This allows the main contact arm laminations 27*m* to open first with less arcing so that erosion created during an arcing process will be confined to the arcing contact arm pairs 27*a*. This can also be accomplished by varying the shapes of the camming surface 131 and the contact pressure lobe 129 of the contact arms 27 so that the moment arm for the arcer laminations 27*a* is increased relative to that of the main arms 27*m.*

Figure 5:
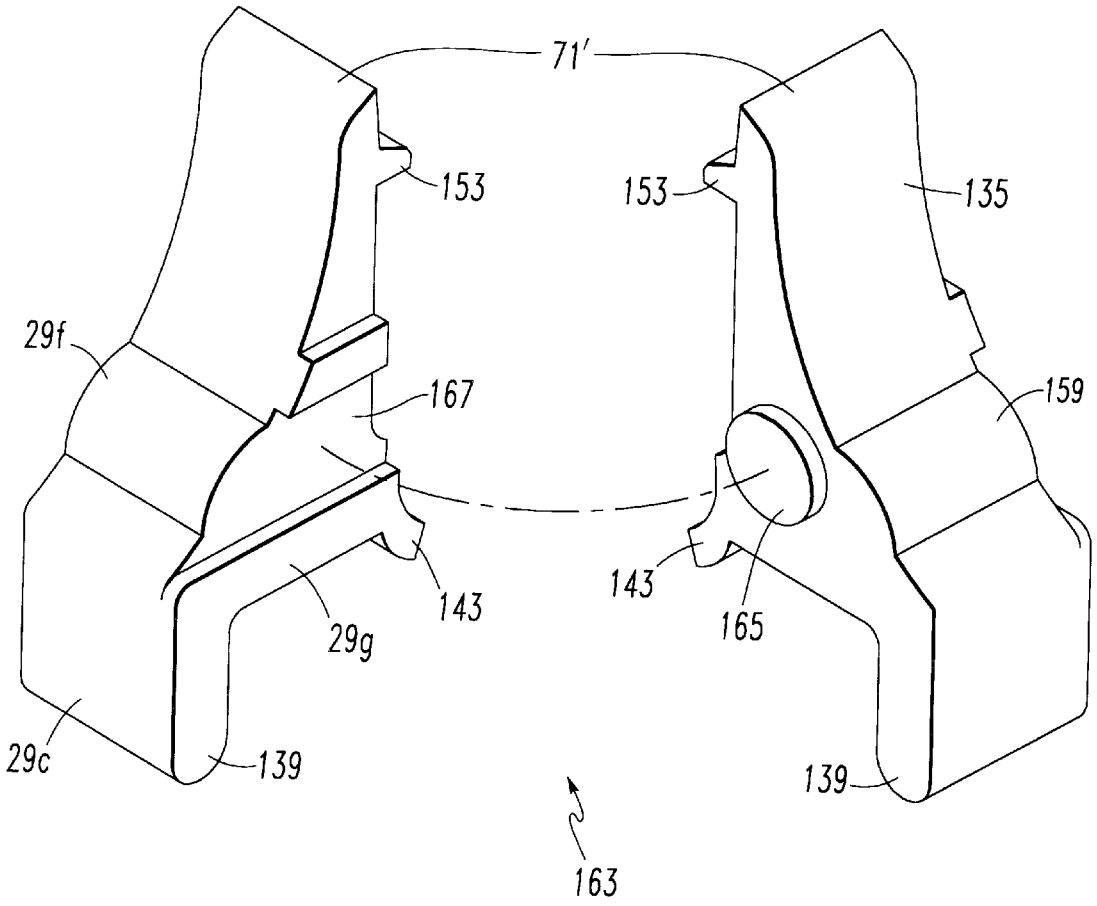
FIG. 5 is an isometric view of an alternate embodiment of cam members which form part of the invention.

Connections can be made between adjacent cam members 71 in order to insure that they begin to blow off together. Coupling must permit each cam a certain amount of individual movement to allow for different rates of contact wear for each conductor lamination. FIG. 5 illustrates modified cam members 71' provided with such a coupling 163. This coupling 163 includes a projection such as the pin 165 on one side of the cam member 71' and an aligned coupling groove 167 on the opposite side. The width of the groove 167 relative to the size of the coupling pin 165 can be selected to provide the desired independent movement of adjacent cam members 71'. When one cam member 71' is depressed just to the point of blowing off, the coupling pin 165 of that cam member 71' will engage the lower edge of the coupling groove of the adjacent cam member causing the spring of the adjacent cam member to be compressed and allowing the adjacent cam to blow off more easily.

The carrier body 43 described above can be made of a variety of materials, such as plastics, cast or machine metals, or powdered metals. The insulation between phases is provided by the molded bearings 79. In order to reduce the size of the carrier and to improve the torsional strength between phases, some modifications to the components can be made.

Figure 6:
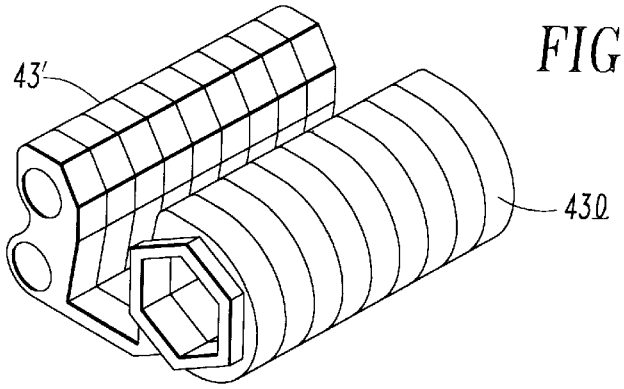
FIG. 6 is an isometric view of an alternate embodiment of a contact arm carrier body which forms part of the circuit breaker of the invention.

FIG. 6 illustrates an alternate carrier body 43' which is made of a stack of laminations 431 which allow carrier bodies for different ratings of the circuit breaker to be assembled from standardized components.

Figure 7:
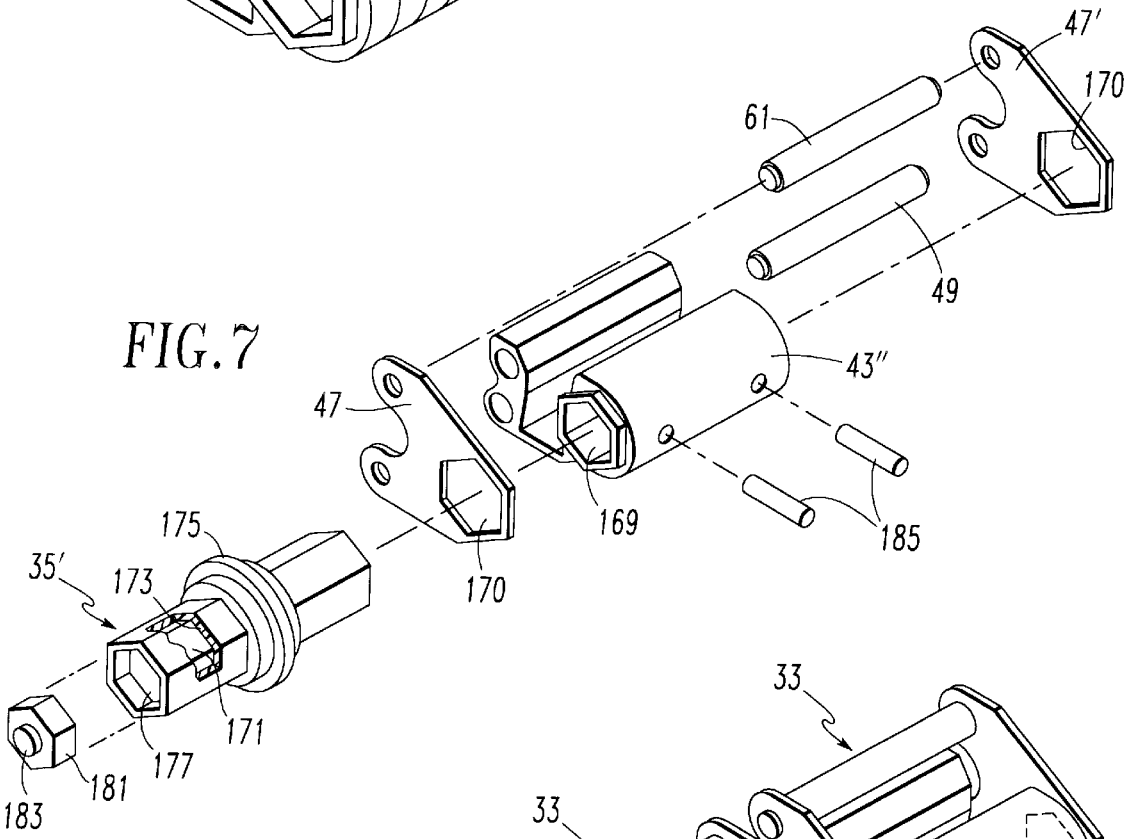
FIG. 7 is an exploded isometric view of a preferred embodiment of a modular crossbar in accordance with the invention.

FIG. 7 shows another alternate embodiment of the carrier body 43". Powder metal technology allows for a stronger part per unit volume than a plastic molding and relatively tight tolerances may be maintained. In this embodiment, a hex tube 169 is made an integral part of the powder metal carrier 43" in order to couple with hex shaped openings 170 in the carrier side plates 47'.

FIG. 7 also shows a modified modular crossbar 35'. A metal, or other suitable material, elongated member or shaft 171 is overmolded with a suitable electrically insulative material 173. The metal is intended to carry the bulk of the torque generated between poles. A bearing 175 is molded integrally with the over molding 173 and at least one end of the crossbar section 171 is covered with the electrically insulative material 177 to reduce the possibility of conducting current between live parts of adjacent poles.

The shaft 171 has end sections sized in length to extend through one-half of each of two adjacent poles. This modular assembly is necessary to permit location of the central carrier between two bearings in the center pole. As the crossbar shaft section 171 only extends through one-half of the carriers 43" in the outer poles, hexagonal plugs 181 inserted in the outer ends of the tubes 169 support the locating pivots 183.

Figure 8:
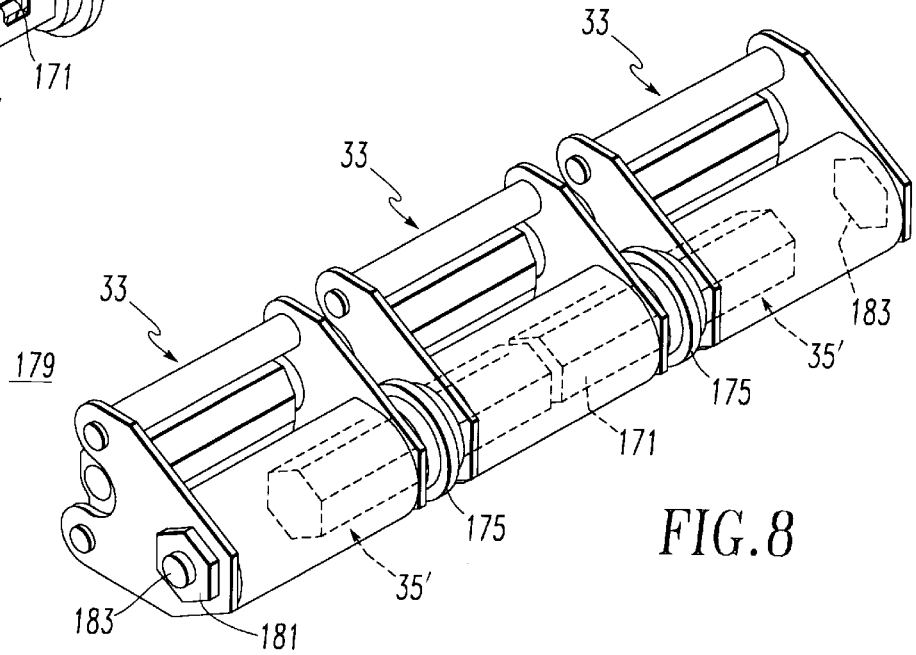
FIG. 8 is an isometric view of an assembly incorporating the modular crossbar of FIG. 7.

FIG. 8 illustrates a three pole crossbar assembly 179 comprised of three carrier subassemblies 33, two modular crossbar members 35', each including an elongated member 171 with an integral bearing 175, and two hexagonal end plugs 181 with locating pins 183 which locate the crossbar ends in the dovetail grooves as described above in connection with FIG. 3. By extension, a 4 pole crossbar assembly (not shown) is built by the addition of one more modular carrier assembly 33 and one more modular crossbar member 35'. Roll pins 185 are driven through the carrier body 43 and the overmolded crossbar shaft section 171 to retain the crossbar assembly lengthwise.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. A circuit breaker comprising:

a molded housing;

a selectable number of poles, each comprising:

a separable set of contacts including a stationary contact and a movable contact;

a moving conductor assembly carrying said movable contact;

a crossbar assembly comprising modular crossbar members connecting adjacent ones of said moving conductor assemblies along a common pivot axis in said molded housing and including a bearing pivotally mounting said moving conductor assemblies;

an operating mechanism coupled to one of said moving conductor assemblies for simultaneously opening said separable sets of contacts in said selectable number of poles by rotation of said moving conductor assemblies coupled by said cross bar members about said common pivot axis;

wherein said modular crossbar members comprise bearings and shaft sections extending axially from said bearings, and coupling means coupling said shaft sections and said adjacent ones of said moving conductor assemblies;

wherein said moving conductor assemblies include contact arms on which said moving contacts are mounted and contact arm carriers from which said contact arms extend, said contact arm carriers having transverse openings in which said shaft sections of said modular crossbar members are received to form said coupling means;

wherein said coupling means comprise a non-cylindrical cross-section on said shaft sections and a complementary cross-section in said openings in said contact arm carriers; and wherein said coupling means further includes pins axially locking said shaft sections in said contact arm carriers.

* * * * *